US011166575B2

(12) United States Patent
Richard et al.

(10) Patent No.: US 11,166,575 B2
(45) Date of Patent: Nov. 9, 2021

(54) FEEDING BOTTLE

(71) Applicant: JOJO2JACK, LLC., Detroit, MI (US)

(72) Inventors: Mallory Alyse Richard, Franklin, MI (US); Jamie Jo Vernon, Wixom, MI (US); Christopher Michael Williams, Midland, MI (US); John E. Nemazi, Bloomfield Hills, MI (US)

(73) Assignee: JOJO2JACK, LLC, Detroit, MI (US)

( * ) Notice: Subject to any disclaimer, the term of this patent is extended or adjusted under 35 U.S.C. 154(b) by 94 days.

(21) Appl. No.: 16/357,043

(22) Filed: Mar. 18, 2019

(65) Prior Publication Data

US 2020/0297137 A1 Sep. 24, 2020

(51) Int. Cl.

| | |
|---|---|
| ***A61J 11/00*** | (2006.01) |
| ***A47G 19/22*** | (2006.01) |
| ***A61J 9/00*** | (2006.01) |

(52) U.S. Cl.

CPC ..... *A47G 19/2272* (2013.01); *A61J 9/005* (2013.01); *A61J 9/006* (2013.01); *A61J 11/00* (2013.01)

(58) Field of Classification Search

CPC . A47G 19/2272; A47G 19/2266; A61J 11/00; A61J 9/006; A61J 9/005; A61J 11/0015

(Continued)

(56) References Cited

U.S. PATENT DOCUMENTS 1,525,314 A * 2/1925 Mullen ..... A61J 11/00 215/11.1

2,039,373 A * 5/1936 Wittmann ..... A61J 11/002 446/180

(Continued)

FOREIGN PATENT DOCUMENTS

GB 2131301 A1 6/1984

OTHER PUBLICATIONS

The Haberman, Mead Johnson, Pigeon, and the New Dr. Brown's, Specialty Feeding System Bottles for Cleft Affected Children, The Medela SpecialNeeds Feeder (formerly Haberman), Mead Johnson Pigeon Nipple and Bottle, Dr. Brown's Specialty Feeding System, Green Sprouts Silicone Bottle, Innobaby Nursin' Smart Silicone Bottle, Comotomo, Prince Lionheart Silicone Bottle, Tendercare Feeder, CLEFTOPEDIA Web page Nov. 19, 2018, 5 pages.

(Continued)

*Primary Examiner* — Ernesto A Grano

(74) *Attorney, Agent, or Firm* — Brooks Kushman P.C.

(57) ABSTRACT

A feeding bottle assembly having a flexible bottle defining a main chamber having a flexible peripheral and a divider member cooperating with the flexible bottle open top and having an opening extending therethrough. A raised lid attached to the open top retaining the divider member therebetween, the raised lid defining an auxiliary chamber with an having an outlet. An elongate liquid pickup tube having a proximate end passes through and sealingly connected to the divider member opening and extending above the divider member to define an auxiliary chamber, and extending below the divider into the main chamber. A nipple is mounted in a raised lid outlet, so that a liquid placed in the main chamber can be transferred to the auxiliary chamber through the pickup tube by squeezing the flexible bottle peripheral wall. The liquid is subsequently consumed by a user drinking from the nipple through a nipple outlet.

12 Claims, 3 Drawing Sheets

(58) Field of Classification Search
USPC ..... 215/6
See application file for complete search history.

(56) References Cited

U.S. PATENT DOCUMENTS 2,442,656 A * 6/1948 Less ..... A61J 11/002 215/11.4
3,044,650 A * 7/1962 Oltion ..... A61J 9/00 215/11.1
3,547,296 A * 12/1970 David ..... A61J 9/006 215/11.4
4,273,272 A * 6/1981 Blanc ..... B05B 11/0059 222/464.4
4,898,290 A * 2/1990 Cueto ..... A61J 9/00 215/11.1
4,940,152 A * 7/1990 Lin ..... A61J 9/00 215/11.1
4,993,568 A * 2/1991 Morifuji ..... A61J 11/002 215/11.1
4,994,076 A * 2/1991 Guss ..... A61J 9/00 215/11.1
5,035,340 A * 7/1991 Timmons ..... A61J 11/002 215/11.4
5,105,956 A * 4/1992 Tarng-Lin ..... A61J 9/00 215/11.1
5,195,664 A * 3/1993 Rhea ..... B05B 11/0059 222/464.4
5,211,298 A * 5/1993 Bloch ..... A47G 19/2266 215/11.1
5,862,927 A * 1/1999 Tebeau ..... A61J 9/00 215/11.1
5,873,474 A * 2/1999 Gray ..... A61J 9/00 215/11.1
5,938,053 A * 8/1999 Verbovszky ..... A47G 19/2272 215/11.1
6,041,951 A * 3/2000 Blum ..... A61J 9/00 215/11.1
6,050,445 A * 4/2000 Manganiello ..... A47G 19/2272 220/714
6,068,147 A * 5/2000 Sheu ..... A61J 9/006 215/11.1
6,394,319 B1 * 5/2002 Pucillo ..... A61J 9/00 222/383.1
7,044,316 B1 * 5/2006 Hsu ..... A61J 9/006 215/11.1
7,320,678 B2 1/2008 Ruth et al.
8,563,013 B2 10/2013 Meehan et al.
8,709,518 B2 4/2014 Young Jones
8,807,386 B2 * 8/2014 Lam ..... A61J 11/002 220/711
8,852,144 B2 10/2014 Al-Thallab
9,566,214 B2 * 2/2017 Eitrheim ..... A61J 1/2093
9,636,280 B1 5/2017 Althallab
10,363,201 B2 * 7/2019 Harush ..... A61J 11/0075
2001/0027956 A1 * 10/2001 Bonacorso ..... A61J 9/006 215/11.1
2004/0060888 A1 * 4/2004 Ahn ..... A61J 9/00 215/11.1
2004/0188372 A1 * 9/2004 Ruth ..... A61J 11/0005 215/11.4
2005/0040054 A1 * 2/2005 Peterson ..... A61J 9/00 206/219
2008/0035596 A1 * 2/2008 Frisch ..... A61J 9/00 215/6
2009/0014403 A1 * 1/2009 Lu ..... A61J 9/04 215/11.5
2010/0314347 A1 * 12/2010 Haberman ..... A61J 9/00 215/6
2011/0309047 A1 * 12/2011 Fucito ..... A61J 9/04 215/11.5
2012/0305515 A1 * 12/2012 Wu ..... A61J 11/045 215/11.1
2014/0163463 A1 * 6/2014 Agbo ..... A61J 7/0046 604/78
2015/0290086 A1 * 10/2015 Prentice ..... A61J 11/045 215/11.5
2016/0067146 A1 * 3/2016 Zhou ..... A61J 9/04 215/11.5
2016/0090454 A1 * 3/2016 Kerns ..... A61J 11/004 604/74
2016/0199262 A1 * 7/2016 Itzek ..... A61J 11/0015 215/11.1
2016/0354287 A1 * 12/2016 Britto ..... A61J 11/02
2017/0105901 A1 * 4/2017 Edgerley ..... A61J 9/00
2018/0110682 A1 * 4/2018 Tran ..... A61J 11/04
2018/0168936 A1 * 6/2018 Stanislawczyk ..... A61J 11/002
2019/0133889 A1 * 5/2019 Roe ..... A61J 9/04
2019/0144173 A1 * 5/2019 Fu ..... B65D 43/0225 222/1
2019/0183740 A1 * 6/2019 Yang ..... B01F 15/00681
2019/0269577 A1 * 9/2019 Reed ..... A61J 9/008
2020/0069528 A1 * 3/2020 Tong ..... A61J 9/005
2020/0237624 A1 * 7/2020 Campbell ..... A61J 9/0669

OTHER PUBLICATIONS

Medela AG, FingerFeeder, www.medela.com Nov. 19, 2018, 4 pages.

* cited by examiner

FEEDING BOTTLE

TECHNICAL FIELD

This application relates to feeding bottles and more particularly to feeding bottles for infants with feeding difficulties.

BACKGROUND

Children with feeding difficulties, particularly those with cleft palates or recovering from palate surgery, have diminished sucking capacity. A cleft palate (the hole or gap where the palate failed to fuse together) and children recovering from palate surgery because the sucking motion and contact of the palate with a bottles spout/nipple can interfere with healing/fistula a cleft palate fistula is defined as a failure of healing or a break down in the primary surgical repair of the palate. Over the years various specialty feeding bottles and free flowing sippy cups have been developed, however there remains a need for a durable feeding bottle which a child with diminished suction can drink liquid out of in the transitioning period for children pre palate repair and out of post Palate repair without the parent or caregiver repeatedly squeezing the bottle to express liquid. In comparison of a "bottles spout and a sippy cup spout" a bottles spout is long and while the child is feeding the spout of the bottle lies between the child's tongue and palate. A "Sippy cup spout" has a short spout and a wide base below the spout. While a child is feeding from a "Sippy cup spout" the wide base rests against the child's upper and lower lips with the spout extended slightly inside the mouth, a sippy cups spout is not long enough to reach the palate.

Children with feeding difficulties, particularly those with cleft palates or recovering from cleft palate surgery, have diminished sucking capacity making feeding very difficult. Over the years various specialty feeding bottles have been developed, however there remains a need for a durable feeding bottle from which a child can drink liquid without having the parent or caregiver repeatedly squeezing the bottle to express liquid.

Examples of specialty feeding bottles for children affected by cleft palate are available from Medela, the "Haberman" Feeder, Mead-Johnson, Pigeon, Dr. Brown's, and Green Sprouts. The Pigeon and Dr. Brown's bottles use a nipple provided with a special one-way valve that goes at the base of the nipple, allowing milk to enter the nipple without flowing back into the bottle reservoir. This design allows the child to drink a limited amount of liquid without requiring the caregiver to squeeze the bottle until the liquid in the nipple is consumed.

The global standard of care recommends a child with a cleft palate be weaned off of a bottle one month prior to surgical repair of the palate. Due to complication risk as noted above. All of the above listed bottles Medela/Haberman feeder, Mead-Johnson, Pigeon, Dr. Browns and Green Spouts should not be used while a child is recovering from palate repair surgery as the sucking motion and the nipple can interfere with the healing processes. Examples of "sippy cups" recommended for usage post palate repair are avent natural drinking cup, nubby super spout, munchkin click lock cup, Nuk Gerber graduates cup like RIM, Tommee Tippee spill proof cup, Playtex tumbler. These cups require less or no suction from a child with decreased sucking capability and the flow is controlled by the child's ability not the caregiver or parent. The experience many families have is that a child has the natural instinct to suck, it is a coping method to children at this age, and a cup without a spout will not give a child that ability. A sippy cup that requires no suction and controlled by the child disperse to much fluid causing the child to gulp and have difficulties feeding. Lastly a bottle feeding that is caregiver controlled is no longer an option at this phase in the child's development or healing processes.

SUMMARY

The Applicant's bottle seeks to solve some of the problems existing in the prior art bottles by providing a bottle having a primary fluid reservoir, and then auxiliary fluid reservoir. A nipple form which the baby drinks is connected to an outlet of the auxiliary reservoir. Squeezing the body of the bottle moves liquid from the primary reservoir to the auxiliary reservoir. The auxiliary reservoir is sized to hold a limited volume of fluid, namely 0.5-2 ounces, and preferably approximately 1 ounce. Once the fluid is transferred to the auxiliary chamber, the baby can drink by sucking on the nipple with minimal sucking effort. The limited volume of the auxiliary reservoir prevents fluid from rapidly dripping form the nipple when the bottle is inverted, while still allowing a relatively low sucking effort. Once the baby has consumed the liquid in the auxiliary chamber, squeezing the bottle, even when the bottle is inverted, transfers additional liquid from the primary reservoir to the auxiliary reservoir. When the bottle is in the upright state, the auxiliary reservoir liquid storage capacity is limited to a predefined level. If the auxiliary reservoir level is overfilled above the predefined level the liquid will return to the primary reservoir.

A feeding bottle is made up of several primary components; a body defining a main chamber having a bottom wall and a flexible peripheral wall along with an open top. A divider member fits in the bottle open top and is provided with an opening extending therethrough. A raised or domed lid is attached to the flexible body bottle open top, retaining the divider member therebetween. The raised lid has an outlet formed on an upper surface thereof. The raised lid defines an auxiliary chamber between the outlet and the divider member, sized to receive a limited volume of liquid. An elongate liquid pickup tube is provided having a proximal end which passes through and sealingly is connected to the divider member opening. The elongate tube extends above the divider member a distance sufficient to define the auxiliary reservoir volume. The elongate pickup tube extends below the divider member at a distance sufficient to enable the distal end of the liquid pickup tube to reach the bottom of the flexible bottle. A nipple from which the baby may drink is coupled to the raised lid outlet. When liquid is placed in the main chamber squeezing the peripheral wall causes liquid to be forced up the liquid pickup tube into the auxiliary chamber where it can be subsequently consumed by the baby drinking from the nipple through a nipple outlet.

Preferably, if the auxiliary chamber is overfilled while the bottle is in the upright orientation excess liquid will flow back into the pickup tube until liquid reaches the desired level.

A preferred embodiment on the feeding bottle, a restrictor member is provided which is located at a distal end of the nipple in the outlet of the raised lid. The restricted member has an open aperture through which liquid can freely pour when the bottle is tipped to an inverted inclined orientation. Tipping the bottle allows liquid to flow from the auxiliary chamber through the restricted member orifice into the nipple without the need to further squeeze the flexible bottle. Once the auxiliary chamber has been consumed, the bottle can be squeezed by the caregiver to refill the auxiliary chamber. Preferably, polarity of interchangeable restrictor members having different sized orifices are provided. This can accommodate the babies in need at various stages of its development. In the preferred embodiment of the invention, the pickup tube is provided with a weighted end so that when the bottle is inclined in the inverted position the pickup tube remains submerged in the liquid in the primary chamber and can be transferred to the auxiliary chamber upon squeezing the bottle.

In one embodiment of the feeding bottle, a restrictor member is located in the raised lid adjacent a distal end of the nipple. A restrictor member is an orifice extending therethrough to control the flow of liquid between the auxiliary chamber and the nipple. When the feeding bottle is tipped into a downwardly inclined orientation, the liquid from the auxiliary chamber comes in contact with the restrictor member and flows through the restrictor member orifice into the nipple. The plurality of the restricted members having different sized orifices can be provided so that the maximum fluid flow rate can be varied according to the baby's needs.

In other embodiments of the feeding bottle, the nipple is oriented adjacent the rim periphery, spaced from the central axis of the feeding bottle. With this nipple orientation, preferably a vent hole is formed in the lid opposite the nipple so that when the bottle is tipped up in and in use, air can be drawn into the auxiliary chamber through the vent hole as the baby drinks from the nipple. In the previously described embodiment with a centrally located nipple, a vent can be provided near the distal end of the nipple to allow air to enter the auxiliary chamber when the bottle is in use yet be sufficiently small so that fluid will not readily leak from the nipple vent when the bottle is inverted and the nipple is filled with fluid.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
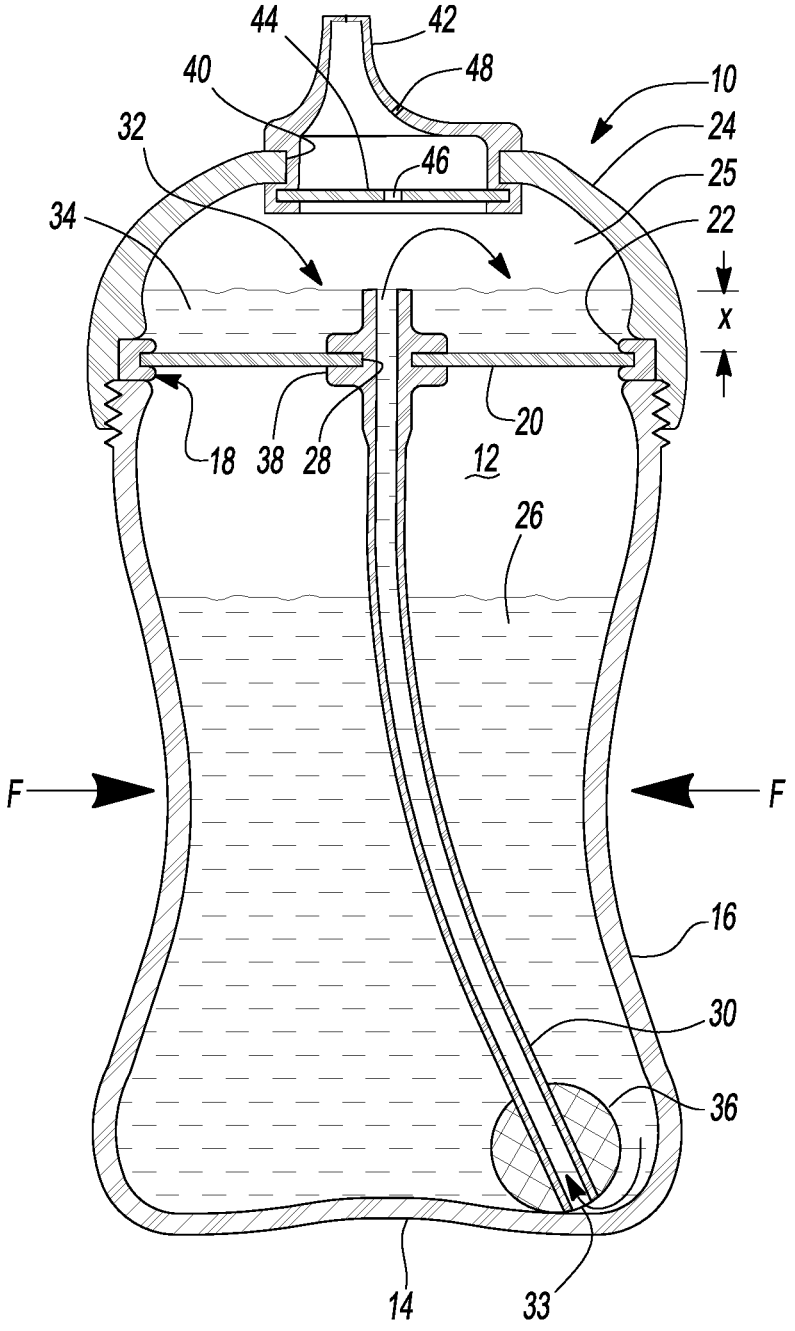
FIG. 1 is a cross-sectional side elevation of the first embodiment of the feeding bottle.

FIG. 1 illustrates a first embodiment of feeding bottle 10 shown in cross-sectional side elevation. The feeding bottle is made up of a flexible bottle 12 having a main chamber 12 which is surrounded by a bottom wall 14 and a peripheral wall 16 which germinates into a top surrounded by a rim 18. Sealingly incorporating with the rim 18 is a divider member 20 which closes the open top. The divider member 20 is preferably provided with an annular seal 22 which engages rim 18. A raised lid 24 is attached to a rim 18 of a flexible bottle open top preferably using a threaded connection. The annular seal 22 of the divider member 20 is retained between the lid 24 and the rim 18 of the flexible bottle 16 as illustrated in FIG. 1. Fluid such as milk 26, is shown in the main chamber 12. The divider member 20 is provided with an opening 28 extending therethrough. An elongate liquid pickup tube 30 is provided with a proximal end 32 which passes through and is sealingly connected to the divider member opening 28 and extends a distance X above the divider member to provide an auxiliary fluid reservoir 34 within an auxiliary chamber 25.

When the flexible bottle 12 is squeezed in the direction of the arrows shown in FIG. 1, the liquid in the air space within the bottle will be pressurized causing fluid to flow up the elongate pickup tube 30 from a submerged distal end 33 up through the feeding tube 30 and exiting the tube proximal end 32 as illustrated in FIG. 1. The fluid fills the auxiliary reservoir 34. If more liquid is transferred to the auxiliary chamber 25 than is shown in reservoir 34 in FIG. 1, that fluid will return to the main chamber 26 through the elongate pickup tube 30 when the flexible feeding bottle 12 is released and springs back to its initial shape. If the liquid level does not exceed the distance X shown in FIG. 1, and the bottle is in a vertical orientation, releasing the squeezing force on a flexible bottle will cause air to enter the auxiliary chamber through the elongate pickup tube 30 so that the air space returns to atmospheric pressure.

Preferably, the feeding tube 30 is provided with a weighted end 36 to keep the distal end 33 of the feeding tube 30 submerged within the liquid 26. The proximal end 32 of the feeding tube 30 is preferably provided with an elastomeric seal 38 which sealingly closes the opening 28 in the divider plate 20. Preferably the liquid pickup tube 30 and the seal 38 are made of a soft flexible rubber material such as silicone or the like. The raised lid 24 is provided with an outlet opening 40, sized to receive a nipple 42 which is inserted therein. The distal end of the nipple 42 is provided with an annular groove on its outside diameter to receive the peripheral section of the raised lid 24 defining the opening 40. In the embodiment illustrated in FIG. 1, the nipple 42 is provided with an annular groove on the inside diameter of the proximal end sized to receive a restrictor member 44 having central aperture 46 therein.

Figure 2A:
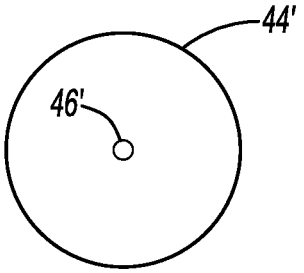
FIGS. 2A-2C are a series of drawings of restrictor members having different sized orifices.
Figure 2B:
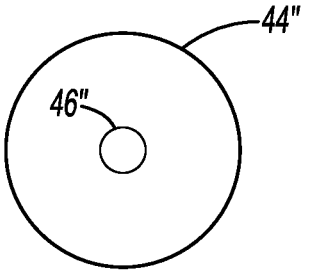
Figure 2C:
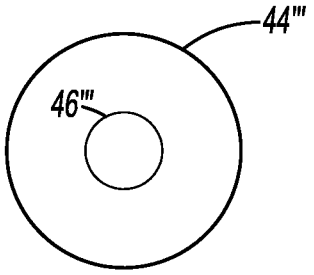

Preferably, a plurality of restrictive plates are provided having different sized central apertures, as illustrated in FIGS. 2A-2C. The restrictor member 44', 44" and 44''' have different sized orifices 46', 46" and 46'''. An appropriate sized restrictor plate orifice is selected based upon the baby's needs and the desired maximum fluid flow rate.

Figure 3:
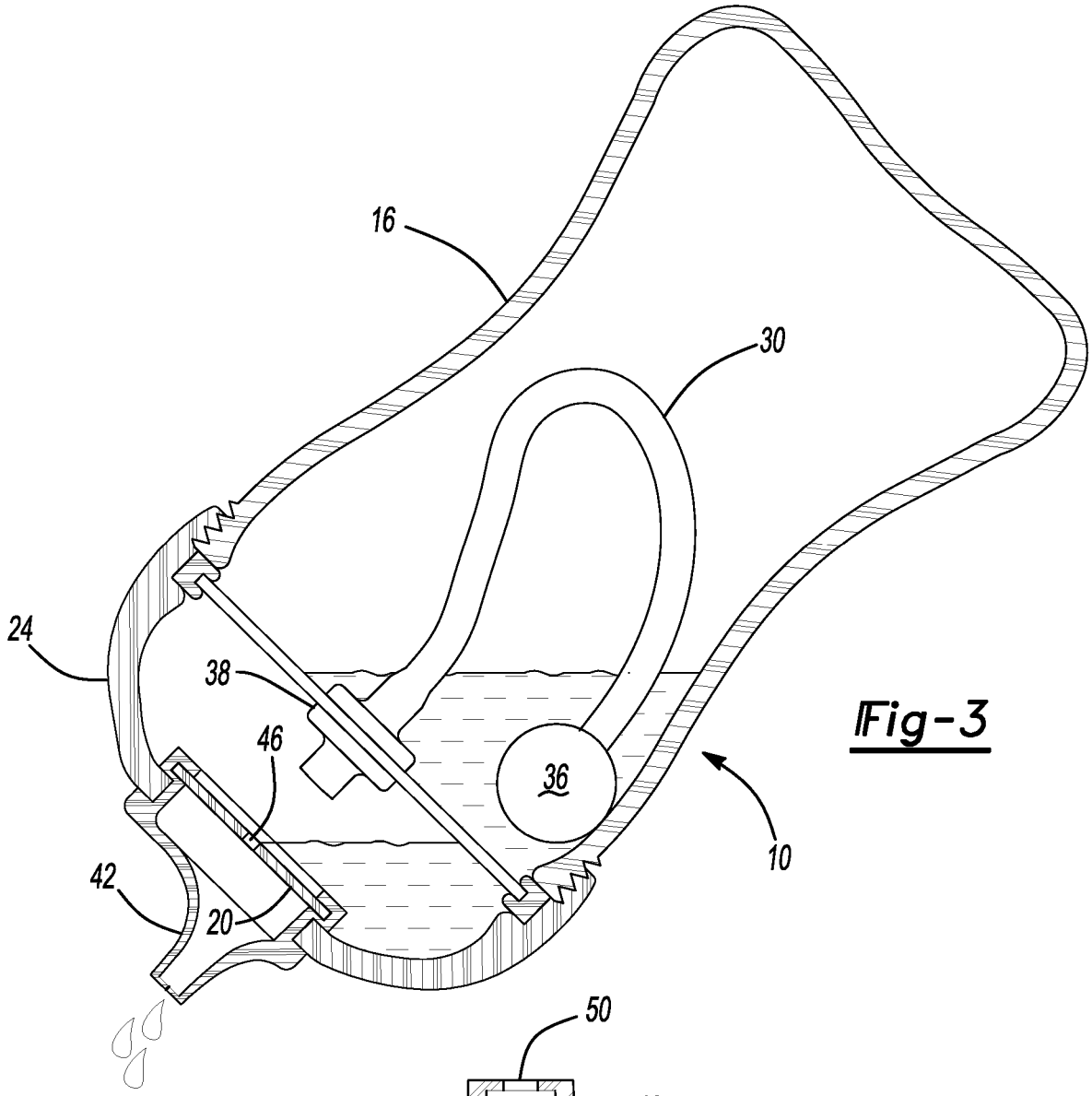
FIG. 3 is a cross-sectional side elevational view of the feeding bottle tipped upward into an inclined feeding position.
Figure 4:
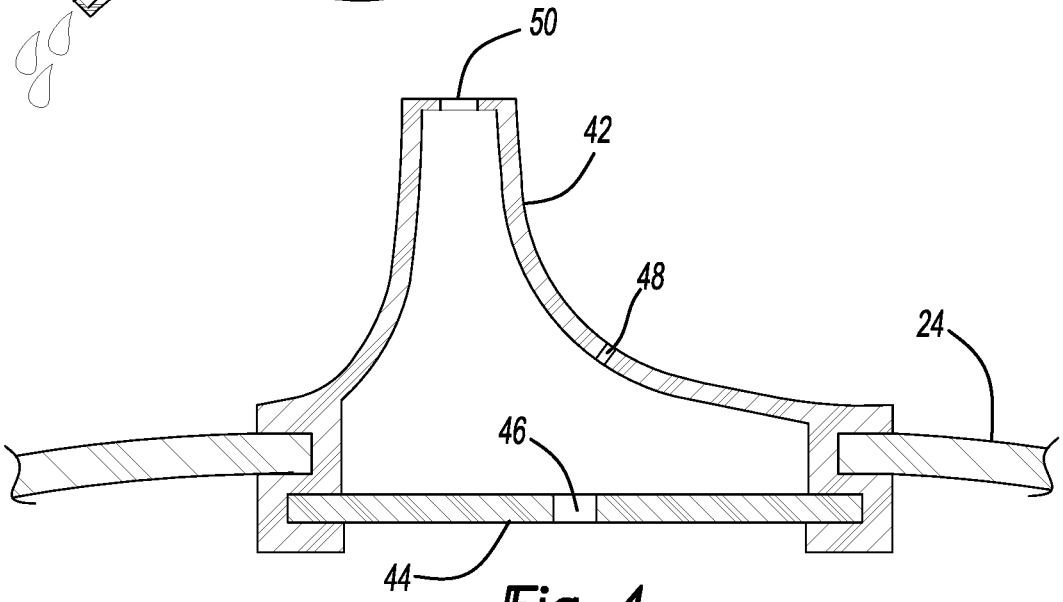
FIG. 4 is an enlarged partial cross-sectional view of the nipple and the restrictor member attached to the outlet formed in the raised lid.

FIG. 3 illustrates feeding bottle 10, downwardly inclined in an in-use position. The fluid in the main chamber 12 settles to the bottom of the main chamber 12 as illustrated, while the fluid in the auxiliary reservoir 34 moves to the bottom of the auxiliary chamber 25 into contact with the restrictor member 44. Fluid flows through the orifice 46 in the restricted member 44, into nipple 42 enabling the baby to drink from the nipple. When the liquid in the nipple is consumed, tipping the bottle 10 upward causes more fluid to transfer from the auxiliary reservoir 34 to the nipple 42 from the orifice 46. After the baby has consumed all of the fluid in the auxiliary reservoir 34, the auxiliary reservoir 34 can be replenished by squeezing the bottle 12 as previously described. Preferably the bottle 10 is returned to the upright position, so that a controlled amount of fluid can be transferred to the auxiliary chamber 25, however with some in-use experience a mother can learn to squeeze the bottle 12 when in the upright position and transfer a limited amount of fluid to the auxiliary chamber 25 without removing the nipple from the feeding baby. Care however should be used so that the auxiliary chamber is not over-filled.

In the downwardly inclined feeding position shown in FIG. 3, the weight 36 is moved to the distal end 33 of the pickup tube 30 within the liquid 26, within the main reservoir. This enables liquid to be transferred from a main chamber 12 to the auxiliary chamber 25 when the bottle 10 is in the downwardly inclined feeding position.

When the baby is drinking from the nipple 42, it is necessary to allow air to enter the auxiliary chamber 25 to prevent a vacuum from hindering fluid flow. In the embodiment illustrated, a small air vent 48 is formed in the nipple 42 at a distance from a proximal end 50 of the nipple 42. Vent 48 is preferably a small slit which opens when there is a pressure differential and which seals shut in this minimal pressure differential. Accordingly, when the bottle 10 is downwardly inclined, fluid will not escape through vent 48. Preferably, the distal end 50 of the nipple 42 is provided with a similar slit opening to limit liquid from freely flowing out of the nipple 42 when the bottle is inverted. The size of the slit opening in the nipple 42 can be varied according to the baby's feeding needs. A large slit, having a "Y" shape, will allow fluid to freely flow form the nipple, while a smaller single slit is much more restrictive requiring more suction by the infant.

Figure 5:
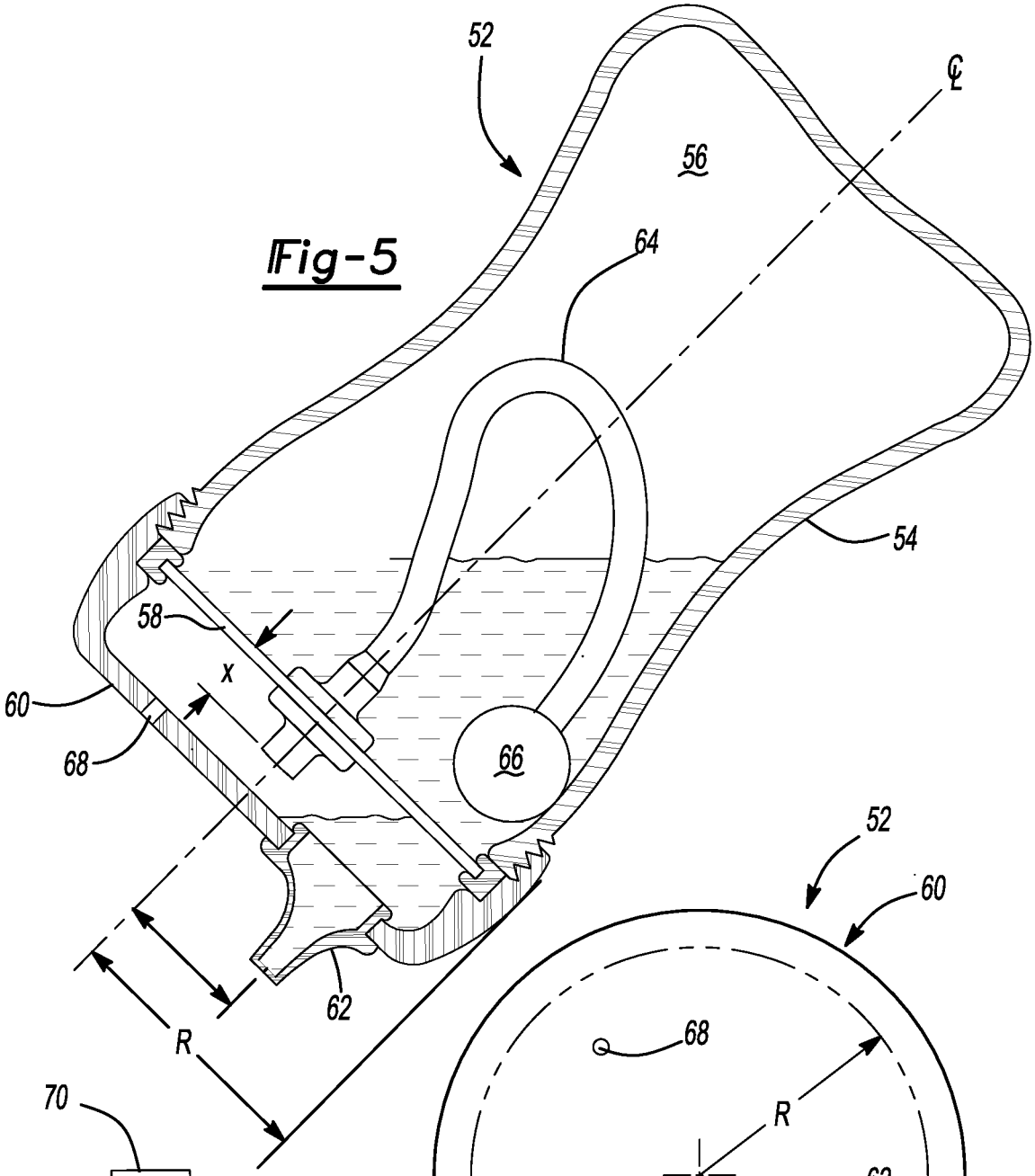
FIG. 5 is a cross-sectional side elevation of a second embodiment of the feeding bottle in a downwardly inclined feeding position.

A second feeding bottle embodiment 52 is illustrated in FIG. 5 in a cross-sectional side elevation shown in the downwardly inclined feeding position. Feeding bottle 52 is similar to feeding bottle 10 in that it has a flexible bottle 54 having a peripheral wall defining a main chamber 56. A divider member 58 is provided closing the open top of the flexible bottle 54. A raised lid 60 is connected to the rim of the flexible bottle open top by cooperating screw threads to entrap the divider member 58 therebetween.

The raised lid 60 is provided with an offset outlet which is fitted with a nipple 62. Like the first embodiment, feeding bottle 52 is provided with an elongate liquid pickup tube 64 having a proximate end and having a length which is sufficient to enable the distal end of the liquid pickup tube 64 to reach the bottom of the flexible bottle 54 when the bottle 52 is standing upright in a vertical orientation. When the bottle is tipped in the inclined feeding position as shown in FIG. 5, a weight 66, located adjacent the distal end of the feeding tube 64, maintains the end of the pickup tube 64 in the liquid within the main chamber 56 regardless of bottle orientation. A proximal end of the elongate pickup tube 64 extends above the divider member 58 a distance X sufficient to define an auxiliary reservoir when in the upright position in the same manner as described in reference to feeding bottle 10 in FIG. 1. When tipped in the downwardly inclined feeding position shown in FIG. 5, the fluid in the auxiliary reservoir falls to the bottom of the auxiliary chamber adjacent the nipple 62 as shown.

Figure 6:
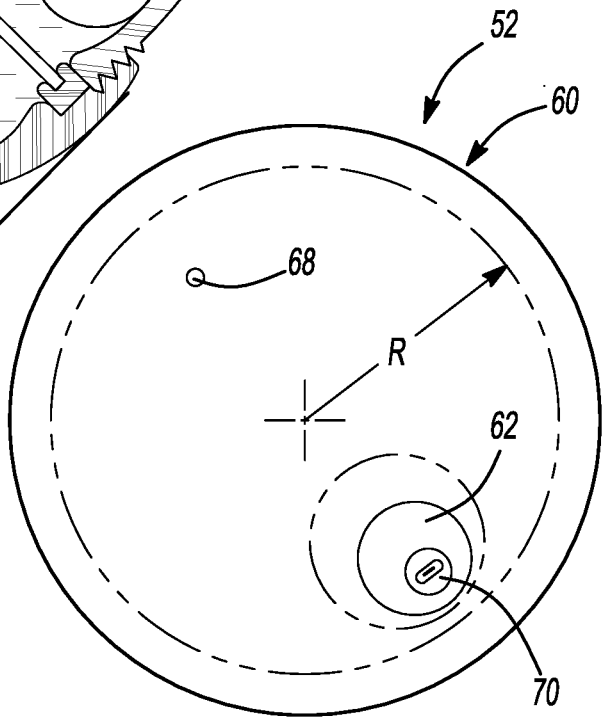
FIG. 6 is a top plan view of the feeding bottle of FIG. 5 having an offset nipple.

FIG. 6 illustrates a top plan view of the feeding bottle 52 showing the offset orientation of nipple 62 relative to the centerline CL of the elongate feeding bottle assembly. Preferably the center of the nipple 62 is located more than 0.25 times the radius R from the center of the feeding bottle 52 shown in the FIG. 6 plan view. Preferably the nipple 62 is positioned adjacent the periphery of the raised lid 60 in plan view as illustrated in FIGS. 5 and 6. Preferably a nozzle outlet near the distal end 50 has a membrane with a slit formed therein so a baby can drink from the nipple 62 with relatively little sucking effort. Preferably this slit provides sufficient flow resistance so that fluid would not freely pour from the nozzle when tipped up in the inclined feeding position shown in FIG. 5. Nipple 62 may be provided with a vent similar to nipple 42 in FIG. 1, however the illustrated FIG. 5 embodiment employs a vent 68 formed in the dome of the raised lid 60, which is generally diametrically opposite the location of the nipple 62 as shown. The vent will be oriented out of the region in which fluid in the auxiliary reservoir is located when the bottle is inclined as shown. Vent 68 may be a simple hole formed through the raised lid 60, or it can be an elastic normally closed member which opens at a differential pressure above a predetermined level. Preferably the predetermined level at which the vent opens is below one inch of water. The slit membrane in the distal end 70 of nipple 62 preferably opens at a predetermined pressure which is above one inch of water. Accordingly, if the bottle is squeezed when in the inclined position air will escape out the vent 68 rather than squirting liquid from the nipple distal end 70.

Figure 7:
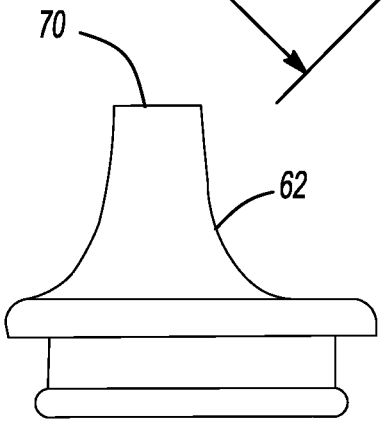
FIG. 7 is a side elevational view of the nipple.

Nipple 62 as shown in side elevation in FIG. 7 can be a standard size baby bottle nipple, having a distal end 70 and having an annular outer diametrical groove for cooperating with the opening in the raised lid. The distal end 70 is provided with a membrane having a slit enabling the baby to drink from the nipple 62. Preferably, a set of color coded nipples are provided having different slit geometries enabling different flow rates to be used for different stages of the child's development.

The feeding bottle can be made of conventional materials. Preferably, the flexible bottle is made of clear or translucent food grade low density polypropylene. The elongate liquid pickup tube as well as the nipple can be made of relatively soft silicone material. The divider member and the raised lid can likewise be formed of polypropylene. Of course, other materials can be used, for example the liquid pickup tube and the nipple may be formed of a latex material and the raised lid and the flexible bottle can be formed of other food grade plastic materials having sufficient rigidity or flexibility to suit the intended purpose.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A feeding bottle assembly comprising:

a flexible bottle defining a main chamber having a bottom wall and a flexible peripheral wall which forms an open top;

a divider member cooperating with the flexible bottle open top and having an opening extending therethrough;

a raised lid attached to the flexible bottle open top retaining the divider member therebetween, the raised lid having an outlet formed therein, the raised lid defining an auxiliary chamber between the outlet and the divider member;

a tube extending from the opening in the divider member projecting above the divider member to define an auxiliary reservoir;

a nipple having a proximal end mounted in the outlet of the raised lid and a distal end forming a nozzle outlet; and a restrictor member having a central open orifice formed therein through which liquid can freely flow, the restrictor being affixable to the proximal end of the nipple adjacent the outlet of the raised lid;

wherein a liquid placed in the main chamber can be transferred to the auxiliary reservoir through the tube so the liquid can be subsequently consumed by a user drinking liquid flowing through a nipple outlet.

2. The feeding bottle assembly of claim 1 further comprising a plurality of interchangeable restrictor members having different size restrictor orifices, where one of the restrictor member or the plurality of interchangeable restrictor members can be affixed to the nipple in order to vary liquid flow rate there through.

3. The feeding bottle assembly of claim 1 further comprising at least one annular seal sealing a periphery of the divider member to at least one of the flexible bottle and the raised lid.

4. The feeding bottle assembly of claim 1 further comprising a plurality of interchangeable nipples having different size nipple outlets, where one of the nipple or the plurality of interchangeable nipples can be affixed to the outlet of the raised lid in order to vary liquid flow rate there through in order to vary the liquid flow rate.

5. The feeding bottle assembly of claim 4 wherein the plurality of interchangeable nipples are provided with a normally closed outlets which have differ maximum flow rates.

6. The feeding bottle assembly of claim 1 wherein the raised lid or the nipple is provided with an air vent to allow air to enter the raised lid as liquid consumed by a user drinking from the nipple.

7. The feeding bottle assembly of claim 1 wherein the feeding bottle assembly is generally cylindrical with an elongate central axis with the nipple being offset from the central axis and spaced a greater distance from the central axis than to a periphery of the raised lid.

8. The feeding bottle assembly of claim 1 wherein the auxiliary chamber has a volume is between 0.5 to 2 fluid ounces when the feeding bottle is in an upright orientation.

9. The feeding bottle assembly of claim 1 wherein the raised lid is circular and has a radius R, and the center of the raised lid outlet is located a distance of at least 0.5 R from the center of the raised lid.

10. The feeding bottle assembly of claim 1 wherein the raised lid or the nipple is provided with an air vent to allow air to enter the raised lid as liquid consumed by a user drinking from the nipple.

11. The feeding bottle assembly of claim 10 wherein the air vent is normally closed, with the air vent closing at a differential pressure below 1 inch of water.

12. The feeding bottle assembly of claim 11 wherein the nipple is provided with a normally closed nipple outlet that closes at a differential pressure which is above that of the air vent.

* * * * *